US012262861B2

(12) United States Patent
Valentin

(10) Patent No.: US 12,262,861 B2
(45) Date of Patent: Apr. 1, 2025

(54) SHOE CLEANING TOOL

(71) Applicant: Steven Valentin, North Chesterfield, VA (US)

(72) Inventor: Steven Valentin, North Chesterfield, VA (US)

( * ) Notice: Subject to any disclaimer, the term of this patent is extended or adjusted under 35 U.S.C. 154(b) by 304 days.

(21) Appl. No.: 18/045,247

(22) Filed: Oct. 10, 2022

(65) Prior Publication Data

US 2023/0165432 A1 Jun. 1, 2023

Related U.S. Application Data

(60) Provisional application No. 63/284,140, filed on Nov. 30, 2021.

(51) Int. Cl.

| | |
|---|---|
| ***A47L 23/04*** | (2006.01) |
| ***A46B 5/02*** | (2006.01) |
| ***A46B 9/02*** | (2006.01) |
| ***A46B 15/00*** | (2006.01) |
| ***A47L 13/12*** | (2006.01) |

(52) U.S. Cl.

CPC ..... *A47L 23/04* (2013.01); *A46B 5/02* (2013.01); *A46B 9/02* (2013.01); *A46B 15/0036* (2013.01); *A46B 15/0055* (2013.01); *A46B 15/0081* (2013.01); *A46B 15/0085* (2013.01); *A47L 13/12* (2013.01); *A46B 2200/306* (2013.01)

(58) Field of Classification Search

CPC ..... A46B 15/0036; A46B 15/0081; A46B 15/0085; A46B 15/0087; A46B 2200/306; A46B 2200/3073; A47L 13/02; A47L 13/08; A47L 13/12; A47L 23/04

USPC ... 15/111, 112, 113, 236.01, 236.07, 236.08; D32/47

See application file for complete search history.

(56) References Cited

U.S. PATENT DOCUMENTS 2,817,864 A * 12/1957 Morton ..... A47L 21/00 15/160
2,830,312 A * 4/1958 Marsak ..... A47L 23/05 401/18
3,270,363 A * 9/1966 Harris, Jr. ..... A47L 23/04 15/113
5,022,650 A * 6/1991 Madock ..... A63B 57/50 15/160

(Continued)

FOREIGN PATENT DOCUMENTS

CN 106073138 A * 11/2016
CN 107772771 A * 3/2018

OTHER PUBLICATIONS

CN 106073138 A; Nov. 9, 2016; Liu.*
CN 107772771 A; Mar. 9, 2018; Xu.*

*Primary Examiner* — Randall E Chin
(74) *Attorney, Agent, or Firm* — Brennan, Manna & Diamond, LLC

(57) ABSTRACT

A tool for cleaning dirt and debris from between the treads of a sole of a shoe, boot, or other footwear. The tool includes a pick member extending from a body that narrows into a tip. The body is configured to be held between a thumb and a finger. Several brushes extend from several holes along a length of the pick member from front to back. The tip of the pick member is used to scrape or dislodge the dirt or debris from between the treads. The brushes may also be used to remove dirt and debris that is not dislodged by the tip. The tool is attachable to a key ring for portability and convenient access.

19 Claims, 6 Drawing Sheets

(56) References Cited

U.S. PATENT DOCUMENTS

| | | | | |
|---|---|---|---|---|
| 5,121,519 | A * | 6/1992 | Haugom | A63B 57/60 15/236.08 |
| 5,485,647 | A * | 1/1996 | Durst | A47L 13/022 15/236.01 |
| D552,316 | S * | 10/2007 | Bloch | D32/46 |
| 8,359,700 | B1 * | 1/2013 | Zeidan | A63F 3/068 30/169 |
| 10,687,689 | B1 * | 6/2020 | Antonucci | A47L 23/04 |
| 2005/0050659 | A1 * | 3/2005 | Chan | A46B 15/0036 433/29 |
| 2005/0217046 | A1 * | 10/2005 | Kury | A47L 23/04 15/113 |
| 2014/0053354 | A1 * | 2/2014 | Tanner | A63F 3/068 15/236.01 |
| 2018/0199793 | A1 * | 7/2018 | Rosin | A46B 11/0041 |

* cited by examiner

SHOE CLEANING TOOL

CROSS-REFERENCE TO RELATED APPLICATION

The present application claims priority to, and the benefit of, U.S. Provisional Application No. 63/284,140, which was filed on Nov. 30, 2021 and is incorporated herein by reference in its entirety.

BACKGROUND

The present invention generally relates to a tool for cleaning a shoe, and more specifically to a portable tool configured to remove dirt and debris from between the treads in a shoe sole. Accordingly, the present specification makes specific reference thereto. However, it is to be appreciated that aspects of the present invention are also equally amenable to other like applications, devices, and methods of manufacture.

There are a wide variety of shoe care products on the market. The vast majority of these products mainly focus on material cleaners, polishes, waxes, brushes, wipes, and the like. Most of these products are designed to protect the upper visible parts of the shoes. People spend a great deal of time and money protecting the upper parts of the shoe. However, there is a clear lack of a product or tool designed to care for the underside or sole of the shoe. A person typically must improvise with tools that are not designed for the task of clearing dirt or debris from between shoe treads.

In recent decades, expensive athletic and designer shoes for men and women have exploded on the fashion market. Keeping these shoes and sneakers clean and in good working condition helps to not only maintain their look and value, but extend the life and longevity of the shoe for the buyer, thereby maximizing their investment. Additionally, work boots and shoes designed for outdoor work typically have deep treads that easily clog. Keeping these boots and shoes in good working condition is a necessity for these workers.

Unfortunately, shoe soles can be difficult to keep clean and in good working condition. Debris and foreign material often become trapped in the sole's grooves. This material can affect the way the shoes hold traction, especially their ability to grip surfaces while walking or running. This can alter the wearer's stride and lead to injury. Further, the material can permanently damage the sole of the shoe if left in place between the treads for an extended period of time. Consumers need a product that is designed to remove this foreign material and keep shoes in good working order.

Accordingly, there is a great need for a way to extend the longevity and life of your favorite pairs of shoes. There is also a need for a tool for cleaning dirt and debris from between the treads of a sole of a shoe, boot, or other footwear. There is also a need for a tool that allows users to remove gum, stones, sticks and other foreign materials with ease. Similarly, there is a need for a shoe cleaning tool that is easily accessible when needed. Further, there is a need for a tool for precise cleaning of grooves and crevices on soles of sneakers.

In this manner, the improved shoe cleaning tool of the present invention accomplishes all of the forgoing objectives, thereby providing an easy solution for removing dirt and debris from the sole of a shoe. A primary feature of the present invention is a tool for cleaning dirt and debris from between the treads of a sole of a shoe, boot, or other footwear that is attachable to a key ring for easy accessibility. The present invention allows for precise cleaning of grooves and crevices on the soles of sneakers. Finally, the improved shoe cleaning tool of the present invention is capable of prolonging the life of footwear.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a shoe cleaning tool. The shoe cleaning tool is configured to remove dirt and debris from between the treads on a bottom of a shoe or other footwear. The shoe cleaning tool comprises a body, a pick member, and a plurality of brush components. The body is configured to be held between a thumb and a finger.

The body comprises a front side and a back side. The front side comprises an indentation configured to receive a thumb. The back side may comprise a textured element. The body further comprises a hole. The hole penetrates the body from the front side through the back side at a top of the body and is configured to engage a key ring. The body may further comprise at least one secondary pick projection extending from along a perimeter of the body.

The pick member comprises a top portion, a pick body, and a tip. The pick member extends downward from a bottom of the body narrowing from the top portion to the tip. The pick member further comprises a plurality of holes located along a length of the pick member. Each of the plurality of holes is sized and configured to retain one of the plurality of brush components. The tip may be blunted, rounded, pointed, or angled to be able to engage dirt or debris caught between the treads on the shoe.

Each of the plurality of brush components are retained within one of the plurality of holes and extend outwardly from front to back. Each brush component comprises a plurality of bristles. The plurality of bristles may vary in length. Each brush component may extend perpendicularly outward from the pick component. Alternatively, at least one of the plurality of brush components may extend angularly downward toward the tip of the pick member, angularly upward toward a top of the pick member, or a combination of different angles.

The shoe cleaning tool may further comprise a lighting component. The lighting component may be integrated into the body and the pick member. The lighting component may comprise a fiberoptic cable configured to project light from the tip of the pick component. The lighting component may be powered by a battery retained within the body.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
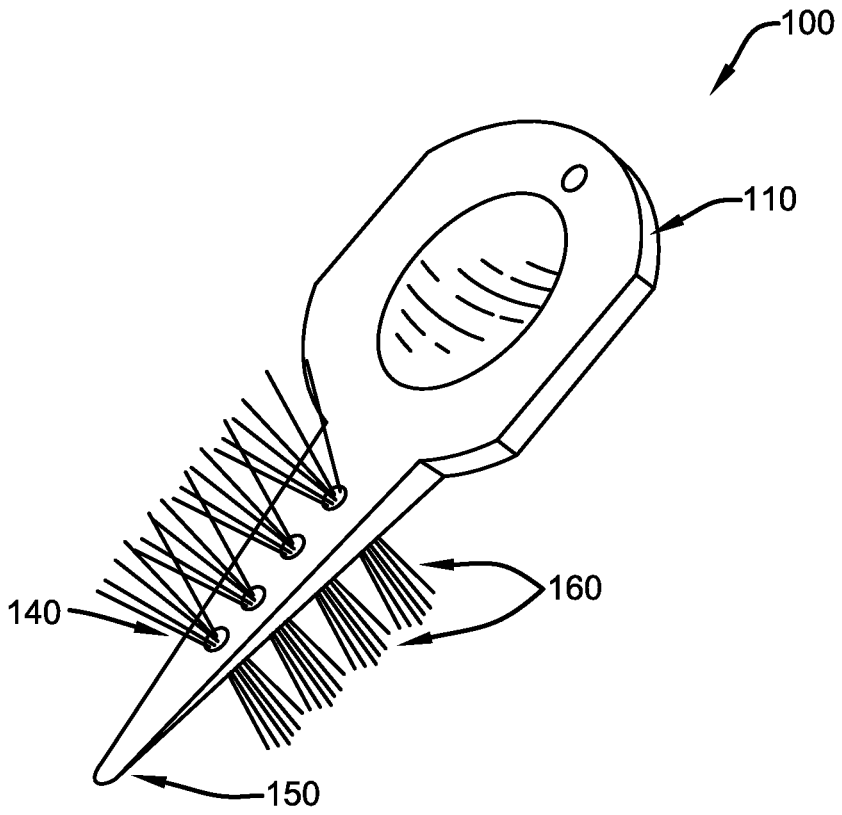
FIG. 1 illustrates a perspective view of a shoe cleaning tool of the present invention configured to remove dirt and debris from between treads on a bottom of a shoe in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The present invention, in one exemplary embodiment, is a lightweight and portable cleaning tool for cleaning dirt and debris from between the treads of a sole of a shoe, boot, or other footwear. The tool includes a pick member that narrows into a tip and extends from a body configured to be held between a thumb and a finger. Several brushes extend from several holes along a length of the pick member from front to back. The tip of the pick member is used to scrape or dislodge the dirt or debris from between the treads. The brushes may also be used to remove dirt and debris that is not dislodged by the tip. The tool is attachable to a key ring for portability and convenient access.

Similar in design to a guitar pick, the device in one embodiment may be approximately two inches in length and one and a half inches in width with a one inch by one inch indented grip surface on either side for the user's thumb and index finger in one embodiment. An approximately one inch elongated bristled tip extension is added to be used for scrubbing. The tool can be made of any solid material such as plastic or steel, and can be attached to a keychain for use on the go. The present invention's simple one-piece guitar pick design with an elongated bristled tip for scrubbing is easy for consumers of all ages to employ.

The user simply grasps the finger shaped depressions on the device's body, and use the bristled tip in conjunction with any shoe cleaner for easy deep cleaning of grooves and crevices on the soles of shoes. The tip extension addresses the issue of tight spaces on shoe soles being hard to reach and clean, easily removing dirt, rocks, twigs and other debris with little effort. The shoe cleaning tool will help to care for and extend the life of expensive designer shoes and sneakers, making it a hot commodity for any shoe collector.

Figure 12:
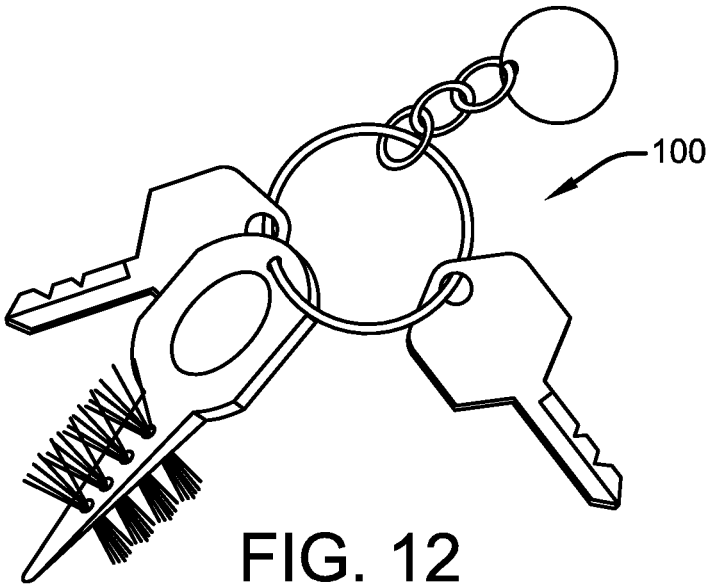
FIG. 12 illustrates a perspective view of the shoe cleaning tool of the present invention configured to remove dirt and debris from between treads on a bottom of a shoe attached to a key chain in accordance with the disclosed architecture.
Figure 13:
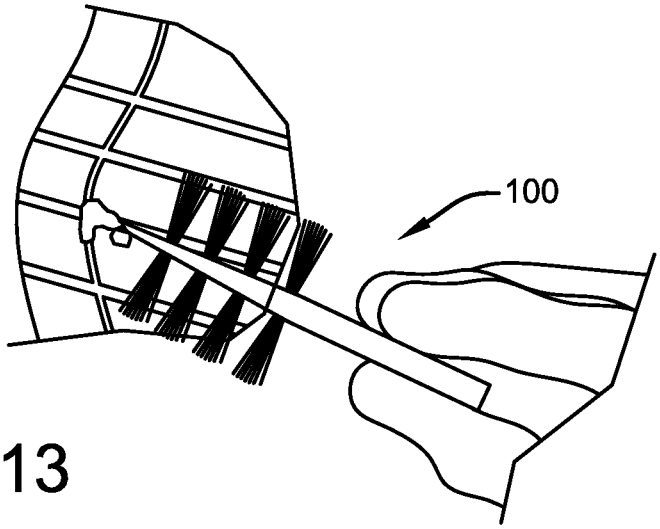
FIG. 13 illustrates a perspective view of the shoe cleaning tool of the present invention being used to remove dirt and debris from between treads on a bottom of a shoe in accordance with the disclosed architecture.
Figure 14:
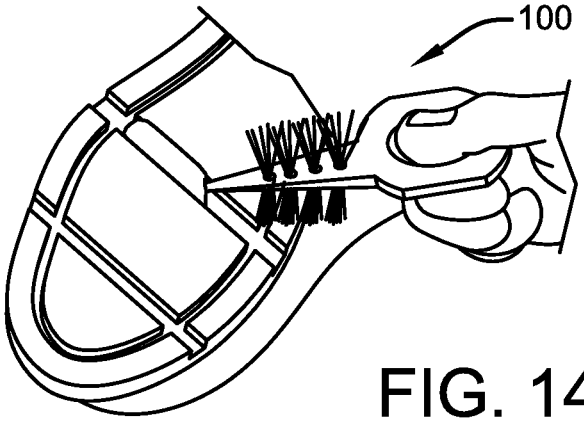
FIG. 14 illustrates a perspective view of the shoe cleaning tool of the present invention being used to remove dirt and debris from between treads on a bottom of a shoe in accordance with the disclosed architecture.

Referring initially to the drawings, FIGS. 1-14 illustrate a shoe cleaning tool 100. The shoe cleaning tool 100 is designed to remove dirt and debris that gets caught between the treads on a bottom of a shoe, a boot, or other footwear as illustrated in FIGS. 13 and 14. As illustrated in FIG. 1, the shoe cleaning tool 100 comprises a body 110, a pick member 140, and a plurality of brush components 160.

Figure 2:
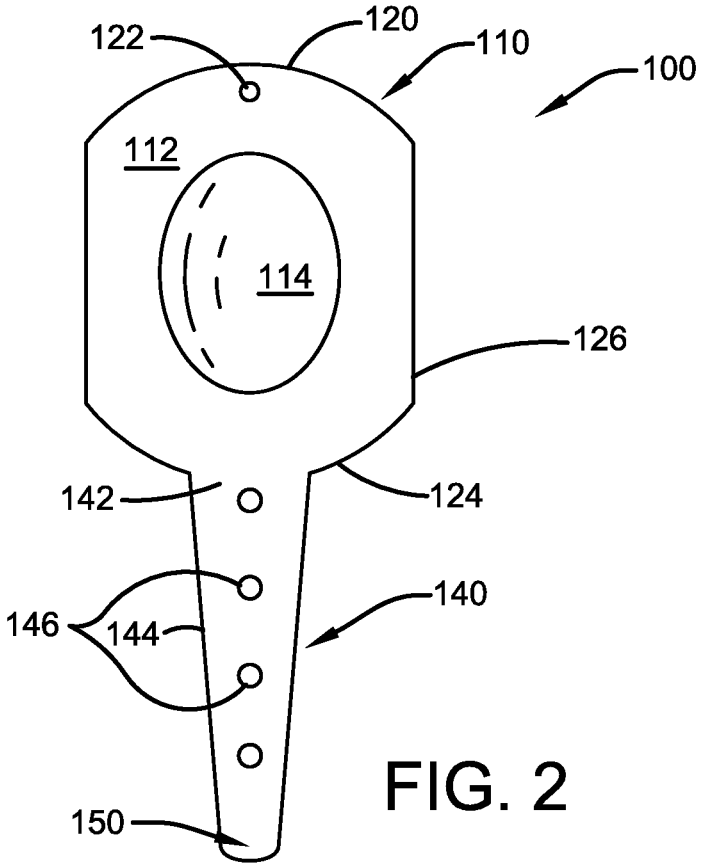
FIG. 2 illustrates a front view of the shoe cleaning tool of the present invention configured to remove dirt and debris from between treads on a bottom of a shoe in accordance with the disclosed architecture.
Figure 3:
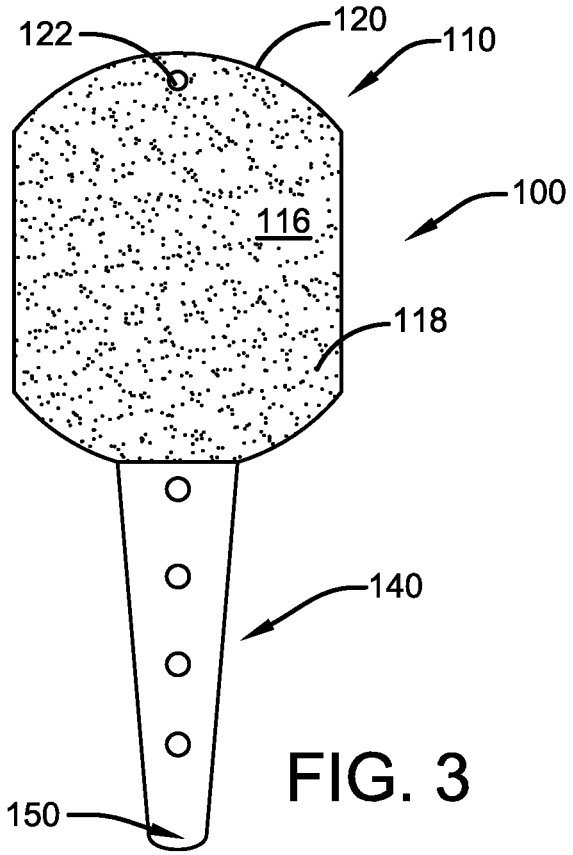
FIG. 3 illustrates a rear view of the shoe cleaning tool of the present invention configured to remove dirt and debris from between treads on a bottom of a shoe in accordance with the disclosed architecture.
Figure 9:
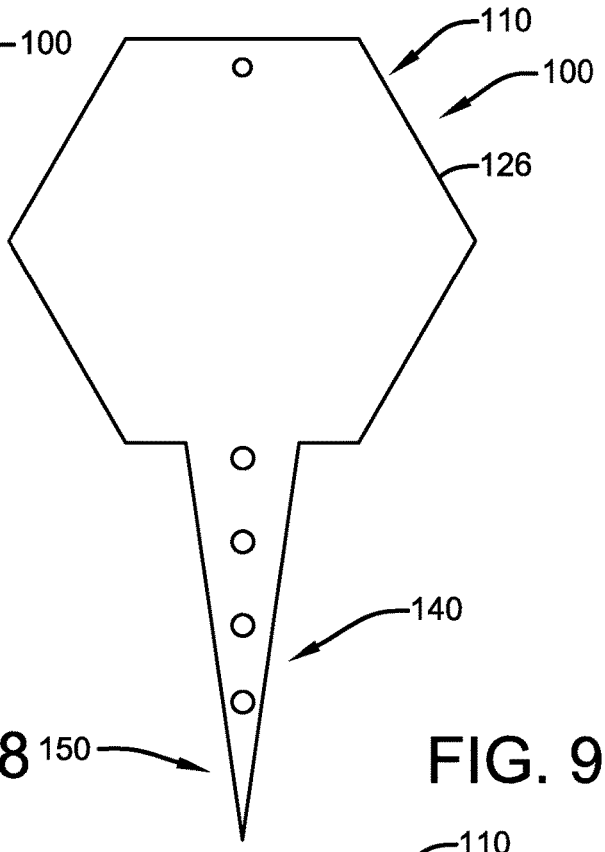
FIG. 9 illustrates a front view of the shoe cleaning tool of the present invention configured to remove dirt and debris from between treads on a bottom of a shoe in accordance with the disclosed architecture.

As illustrated in FIGS. 2 and 3, the body 110 comprises a front side 112 and a back side 116. The body 110 is configured to be held between a thumb and a finger. The body 110 and the pick member 140 may be constructed from plastic or metal via molding, additive manufacturing, 3D printing, punching, cutting, or the like. The body 110 may be oval or rounded in shape, similar to a guitar pick, or may be any other geometric shape, an example of which is illustrated in FIG. 9. The body 110 and the pick member 140 may be clear, colored, translucent, or fluorescent.

The front side 112 comprises an indentation 114. The indentation 114 is a depression configured to receive a thumb and may be rounded, oval, or thumb shaped in shape. The back side 116 may comprise a textured element 118. The textured element 118 provides a better gripping surface for the finger and may be attached to or built into the back side 116. A plurality of indicia, such as logos, branding, or the like may be added to the front or back sides 112 and 116. The body 110 further comprises a hole 122. The hole 122 penetrates the body 110 from the front side 112 through the back side 116. The hole 122 is typically located at or toward a top 120 of the body 110 and is configured to engage a key ring as illustrated in FIG. 12.

Figure 11:
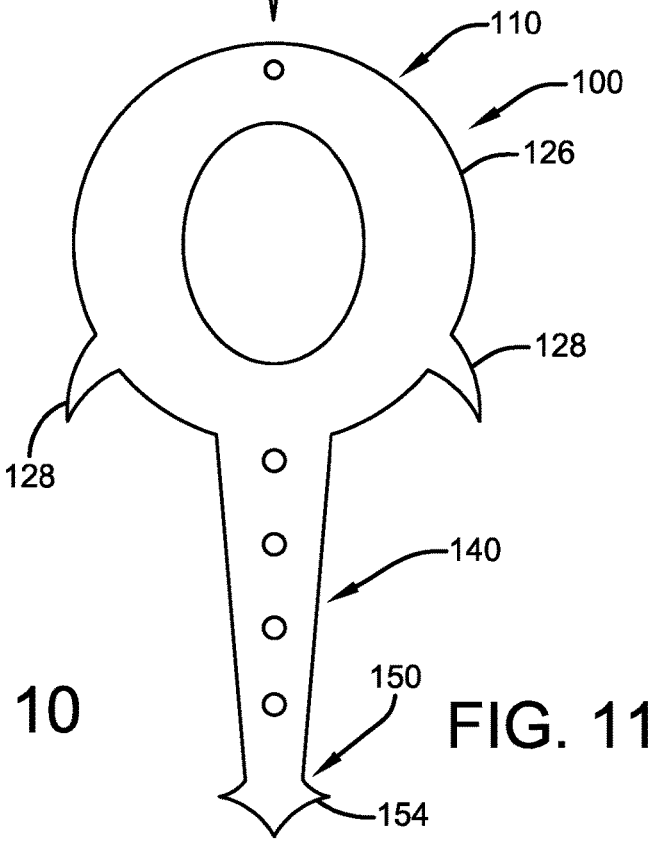
FIG. 11 illustrates a front view of the shoe cleaning tool of the present invention configured to remove dirt and debris from between treads on a bottom of a shoe in accordance with the disclosed architecture.

As illustrated in FIG. 11, the body 110 may further comprise at least one secondary pick projection 128. The at least one secondary pick projection 128 extends from along a perimeter 126 of the body 110. The at least one secondary pick projection 128 is shorter than the pick member 140 for better leverage and is also configured to remove dirt and debris from between the treads of a shoe. The at least one secondary pick projection 128 may be blunted, rounded, pointed, angled, or hook-shaped in configuration.

As illustrated in FIGS. 1-4, the pick member 140 comprises a top portion 142, a pick body 144, and a tip 150. The top portion 142 of the pick member 140 extends downward from a bottom 124 of the body 110 narrowing or tapering from the top portion 142 of the pick member 140 to the tip 150. The pick member 140 further comprises a plurality of holes 146. The plurality of holes 146 are located along a length of the pick member 140 extending from front to back. Each of the plurality of holes 146 is sized and configured to retain one of the plurality of brush components 160. In one embodiment, the plurality of holes 146 are four in number.

Figure 7:
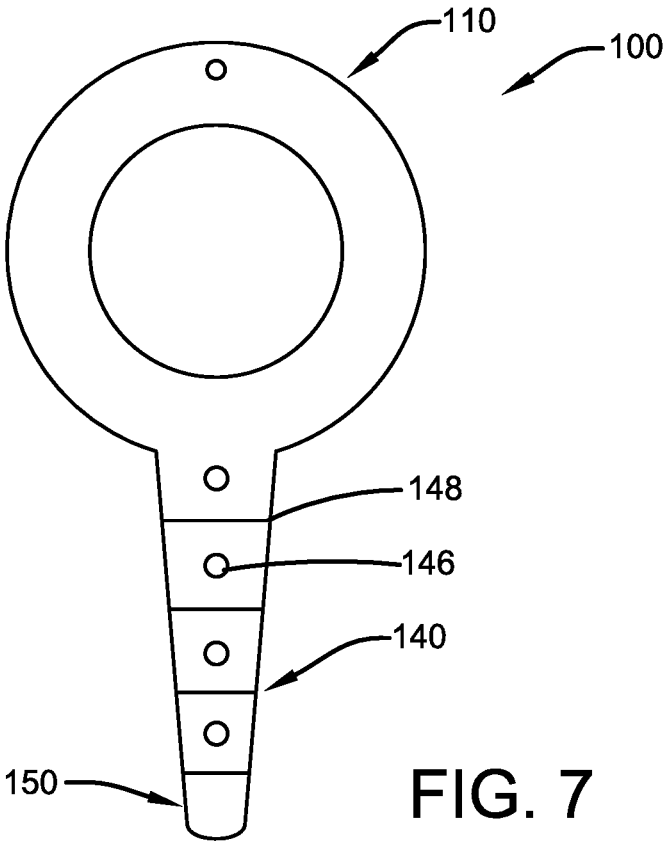
FIG. 7 illustrates a front view of the shoe cleaning tool of the present invention configured to remove dirt and debris from between treads on a bottom of a shoe in accordance with the disclosed architecture.

As illustrated in FIG. 7, the pick member 140 may further comprise a plurality of fracture lines 148. The plurality of fracture lines 148 are positioned between the plurality of holes 146 and are designed to fracture off a part of the pick member 140 if excessive pressure is applied preserving the rest of the pick member 140.

Figure 10:
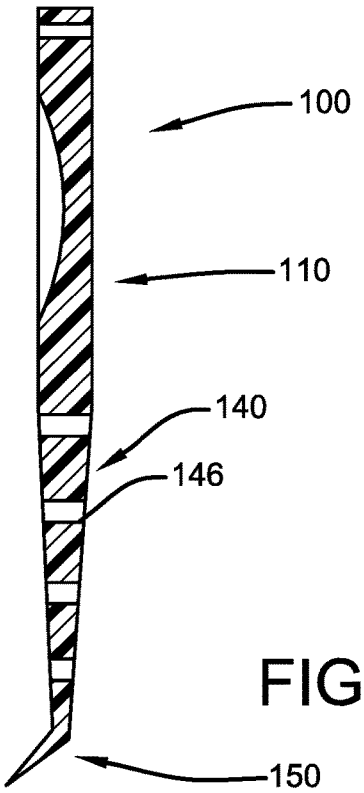
FIG. 10 illustrates a cross-sectional view of the shoe cleaning tool of the present invention configured to remove dirt and debris from between treads on a bottom of a shoe in accordance with the disclosed architecture.

The tip 150 is shaped to fit between the treads of the shoe and is sturdy enough to remove dirt or debris, but is still generally flexible. The tip 150 may be blunt, rounded, or pointed in shape to engage dirt or debris caught between the treads on the shoe as illustrated in FIGS. 5-9. As illustrated in FIG. 6, the tip 150 may comprise an eyelet hole 152 configured to better scrape out debris. As illustrated in FIG. 11, the tip 150 may further comprise a plurality of projections 154 for better removing debris. As illustrated in FIG. 10, the tip 150 may be angled to provide better leverage.

Figure 4:
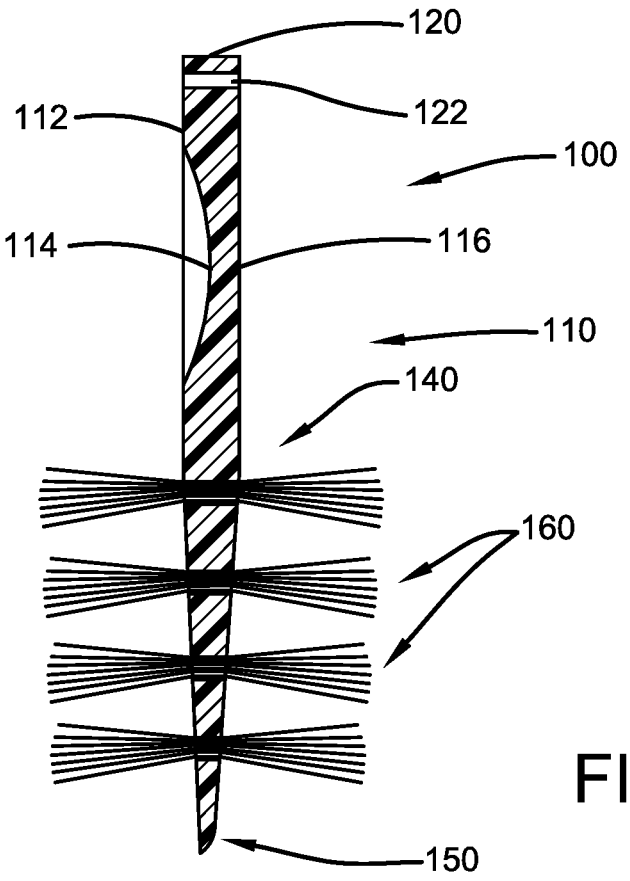
FIG. 4 illustrates a cross-sectional view of the shoe cleaning tool of the present invention configured to remove dirt and debris from between treads on a bottom of a shoe in accordance with the disclosed architecture.
Figure 5:
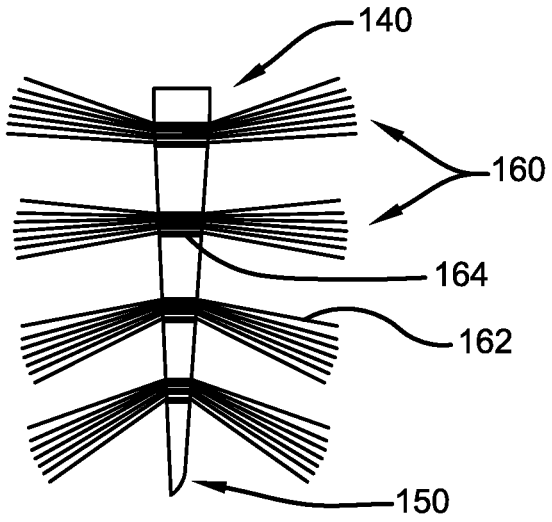
FIG. 5 illustrates a front view of a pick member and a plurality of brush components of the shoe cleaning tool of the present invention configured to remove dirt and debris from between treads on a bottom of a shoe in accordance with the disclosed architecture.
Figure 6:
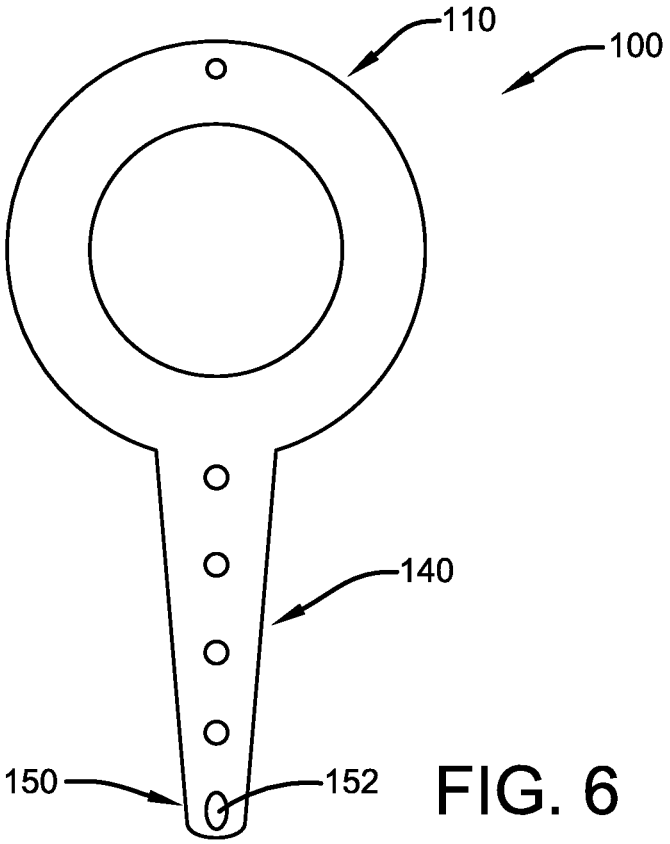
FIG. 6 illustrates a front view of the shoe cleaning tool of the present invention configured to remove dirt and debris from between treads on a bottom of a shoe in accordance with the disclosed architecture.

As illustrated in FIGS. 4 and 5, each of the plurality of brush components 160 are retained within one of the plurality of holes 146. Each of the plurality of brush components 160 extend outwardly from the pick member 140 from front to back. Each brush component 160 comprises a plurality of bristles 162. The plurality of bristles 162 may each vary in length or may be equal in length. The plurality of bristles 162 may be held in place within each corresponding hole 146 via adhesive, friction, or a mechanical fastener 164. In one embodiment, the plurality of brush components 160 are four in number. The plurality of bristles 162 may be plastic, metal, natural bristle material, wood, or the like.

Each brush component 160 may extend approximately perpendicularly outward from the pick component 140 through each hole 146. As illustrated in FIG. 5, at least one of the plurality of brush components 160 may extend angularly downward toward the tip 150 of the pick member 140. Further, at least one of the plurality of brush components 160 may extend angularly upward toward a top 142 of the pick member 140. The plurality of brush components 160 may extend at any combination of different angles, including sideways or in a splayed pattern.

Figure 8:
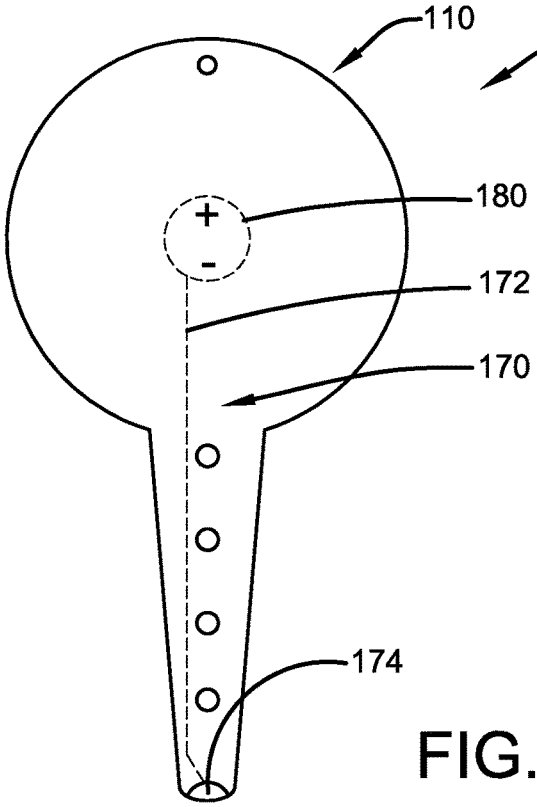
FIG. 8 illustrates a front view of the shoe cleaning tool of the present invention configured to remove dirt and debris from between treads on a bottom of a shoe in accordance with the disclosed architecture.

As illustrated in FIG. 8, the shoe cleaning tool 100 may further comprise a lighting component 170. The lighting component 170 may be integrated or molded into the body 110 and the pick member 140. The lighting component 170 may be a light emitting diode 174 located at the tip 150. Alternatively, the lighting component 170 may comprise a fiberoptic cable 172. The fiberoptic cable 172 is configured to project light from the tip 150 of the pick component 140. The lighting component 150 may be powered by a battery 180 retained within the body 110 in electrical communication with the lighting component 170.

Notwithstanding the forgoing, the shoe cleaning tool 100 can be any suitable size, shape, and configuration as is known in the art without affecting the overall concept of the invention, provided that it accomplishes the above stated objectives. One of ordinary skill in the art will appreciate that the shape and size of the shoe cleaning tool 100 and its various components, as show in the FIGS. are for illustrative purposes only, and that many other shapes and sizes of the 100 are well within the scope of the present disclosure. Although dimensions of the shoe cleaning tool 100 and its components (i.e., length, width, and height) are important design parameters for good performance, the shoe cleaning tool 100 and its various components may be any shape or size that ensures optimal performance during use and/or that suits user need and/or preference. As such, the shoe cleaning tool 100 may be comprised of sizing/shaping that is appropriate and specific in regard to whatever the shoe cleaning tool 100 is designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A shoe cleaning tool comprising:

a body;

a pick member extending from the body, the pick member comprising a plurality of holes and a tip; and a plurality of brush components, each brush component retained within and extending from a corresponding one of the plurality of holes; and wherein the pick member further comprises a plurality of fracture lines positioned between the plurality of holes.

2. The shoe cleaning tool of claim 1, wherein the pick member narrows from a top of the pick member to the tip.

3. The shoe cleaning tool of claim 1, wherein the body comprises an indentation in a front side of the body configured to receive a thumb.

4. The shoe cleaning tool of claim 1, wherein the body comprises a textured element on a back side of the body.

5. The shoe cleaning tool of claim 1, wherein the body comprises a hole at a top of the body for engaging a keyring.

6. The shoe cleaning tool of claim 1, wherein the tip is blunt.

7. The shoe cleaning tool of claim 1, wherein the tip is pointed.

8. The shoe cleaning tool of claim 1, wherein each brush component comprises a plurality of bristles of different lengths.

9. The shoe cleaning tool of claim 1, wherein each brush component extends perpendicularly outward from the pick member.

10. The shoe cleaning tool of claim 1, wherein at least one of the plurality of brush components extends angularly downward from the pick member.

11. The shoe cleaning tool of claim 1, wherein at least one of the plurality of brush components extends angularly upward from the pick member.

12. The shoe cleaning tool of claim 1, wherein the tip is angled.

13. The shoe cleaning tool of claim 1 further comprising a lighting component integrated into the body and the pick member.

14. The shoe cleaning tool of claim 1, wherein the body comprises at least one secondary pick projection extending outward from a perimeter of the body.

15. A shoe cleaning tool comprising:

a body comprising an indentation in a front side of the body;

a pick member extending from a bottom of the body, the pick member comprising a plurality of holes and a tip, the pick member narrowing from a top of the pick member to the tip; and a plurality of brush components, each brush component retained within and extending from a corresponding one of the plurality of holes; and wherein the pick member further comprises a plurality of fracture lines positioned between the plurality of holes.

16. The shoe cleaning tool of claim 15, wherein the body and the pick member are fluorescent.

17. The shoe cleaning tool of claim 15, wherein the tip is angled.

18. The shoe cleaning tool of claim 15 further comprising a fiberoptic lighting component integrated into the body and the pick member for projecting light out of the tip.

19. A shoe cleaning tool comprising:

a body comprising an indentation in a front side of the body and a textured element on a back side of the body;

a pick member extending from the body, the pick member comprising four holes extending along a length of the pick member and a tip, the pick member narrowing from a top of the pick member to the tip; and four brush components, each brush component retained within and extending from a corresponding one of the four holes, wherein at least one of the plurality of brush components extends perpendicularly outward from the pick member and at least one of the plurality of brush components extends angularly downward from the pick member; and wherein the pick member further comprises a plurality of fracture lines positioned between the four holes.

* * * * *